US005105171A

United States Patent [19]

Wen et al.

[11] Patent Number: 5,105,171

[45] Date of Patent: Apr. 14, 1992

[54] COPLANAR WAVEGUIDE DIRECTIONAL COUPLER AND FLIP-CLIP MICROWAVE MONOLITHIC INTEGRATED CIRCUIT ASSEMBLY INCORPORATING THE COUPLER

[75] Inventors: Cheng P. Wen, Mission Viejo; Gregory S. Mendolia, Torrance, both of Calif.

[73] Assignee: Hughes Aircraft Company, Los Angeles, Calif.

[21] Appl. No.: 692,833

[22] Filed: Apr. 29, 1991

[51] Int. Cl.[5] ..... H01P 5/18

[52] U.S. Cl. ..... 333/116; 333/115; 333/238

[58] Field of Search ..... 350/96.11, 96.12, 96.13, 350/96.14; 333/109, 113, 116, 115, 114, 128, 133, 204, 238

[56] References Cited

U.S. PATENT DOCUMENTS

| | | | |
|---|---|---|---|
| 4,178,568 | 12/1979 | Gunton | 333/116 |
| 4,636,754 | 1/1987 | Presser et al. | 333/116 |
| 4,937,541 | 6/1990 | Podell et al. | 333/116 |
| 5,006,821 | 4/1991 | Tam | 333/116 |
| 5,012,209 | 4/1991 | Lantagne et al. | 333/116 |
| 5,032,803 | 7/1991 | Koch | 333/116 |

FOREIGN PATENT DOCUMENTS

| | | | |
|---|---|---|---|
| 1964412 | 9/1980 | Fed. Rep. of Germany | 333/116 X |

OTHER PUBLICATIONS

Jackson, "Introduction to Lange Coupler Design", Microwave Journal, Oct. 1989, pp. 145–149.

Wen, Cheng P.; "Coplanar-Waveguide Directional Couplers;" *IEEE Transactions On Microwave Theory and Techniques*; Jun. 1970, pp. 318–322.

Lange, Julius, "Interdigitated Stripline Quadrature Hybrid;" *IEEE Transactions on Microwave Theory and Techniques*; Dec. 1969, pp. 1150–1151.

*Primary Examiner*—Brian Healy

*Attorney, Agent, or Firm*—Jeannette M. Walder; Terje Gudmestad; W. K. Denson-Low

[57] ABSTRACT

A coplanar waveguide directional coupler (116,134) may be formed on a surface (102a,106a) of a substrate (102) and/or a microwave monolithic integrated circuit (MMIC) chip (106), with the MMIC chip (106) being flip-chip mounted on the substrate (102). The directional coupler (116,134) includes an input port (114,136), a coupled port (126,154), a direct port (122,152) and an isolation port (1118,150) formed on the surface (102a,106a). At least two parallel first striplines (24,26) are formed on the surface (102a,106a), having first ends connected to the input port (114,136) and second ends connected to the direct port (122,152). At least two parallel second striplines (36,38) are formed on the surface (102a,106a), having first ends connected to the coupled port (126,154) and second ends connected to the isolation port (118,150). The second striplines (36,38) are interdigitated with the first striplines (24,26) to provide tight signal coupling therebetween. First and second main ground planes (52,54) are formed on the surface (102a,106a) and extend parallel to and on opposite respective sides of the interdigitated first and second striplines (24,26,36,38). The input port (114,136), coupled port (126,154), direct port (122,152) and isolation port (118,150) each include a coplanar waveguide section having a center conductor (14a,16a,18a,20a) connected to the ends of the respective striplines (24,26,36,38), and first and second ground planes (14b,14c), (16c,16c), (18b,18c, (20b,20c) which extend parallel to the center conductor (14a,16a,18a,20a) on opposite sides thereof and are connected in circuit to the main ground planes (52,54).

12 Claims, 3 Drawing Sheets

FIG. 1.

COPLANAR WAVEGUIDE DIRECTIONAL COUPLER AND FLIP-CLIP MICROWAVE MONOLITHIC INTEGRATED CIRCUIT ASSEMBLY INCORPORATING THE COUPLER

BACKGROUND OF THE INVENTION

1. Field of the Invention

The present invention relates to a coplanar waveguide directional coupler which may be advantageously incorporated into flip-chip microwave monolithic integrated circuit (MMIC) arrangements.

2. Description of the Related Art

A directional coupler to which the present invention relates, also known as a "hybrid", is a four port junction device. In an ideal directional coupler, a signal applied to one of the ports is coupled to two of the other ports with a desired coupling ratio, but no part of the signal is coupled to the fourth port. Directional couplers may alternatively be connected to function as RF signal splitters, power combiners, or balanced mixers.

Coplanar waveguide transmission lines are desirable for the interconnection of component elements in microwave assemblies due to their easy adaptation to external shunt element connections as well as to monolithic integrated circuits fabricated on semi-insulating substrates. A coplanar waveguide directional coupler was proposed by Cheng P. Wen, one of the present inventors, in an article entitled "Coplanar Waveguide Directional Couplers", in IEEE Transactions on Microwave Theory and Techniques, June 1970, pp. 318–322. The proposed directional coupler includes two closely spaced signal conductor striplines, and two ground planes disposed on the opposite sides of the striplines. Although suitable for operation at relatively low RF frequencies, the circuit dimensions required to achieve tight coupling for a 3dB (quadrature) coupling at microwave frequencies (10.6 GHz or higher) are beyond the practical limits of microwave integrated circuit fabrication technology.

In the coplanar waveguide directional coupler discussed above, a coupling coefficient K is defined as $$K=(Zoe-Zoo)/(Zoe+Zoo)$$

where Zoe and Zoo are the even- and odd-mode impedances of the transmission lines. The directional coupler will operate with minimum reflection if the four ports are matched with an impedance $Zo=Zoe\times Zoo$. For the case of a 3dB coupler, $K^2=\frac{1}{2}$, and the even- and odd-mode impedances are 120.71 ohms and 20.71 ohms respectively. The gap between two 20 micrometer wide parallel metallic striplines on a substrate having a dielectric constant of 13 must be approximately one micrometer to achieve the desired coupling. This narrow gap requirement over the length of a directional coupler (approximately one quarter of the anticipated signal wavelength) is beyond the existing fine line lithographic capabilities in a current manufacturing environment.

Another type of directional coupler is generally known in the art as a "Lange coupler", and is described in an article entitled "Interdigitated Stripline Quadrature Hybrid", by Julius Lange, in IEEE Transactions on Microwave Theory and Techniques, Dec. 1969, pp. 1150–1151. The Lange coupler includes three or more parallel striplines with alternate lines tied together.

The conventional Lange coupler is not suitable for coplanar waveguide based MMIC fabrication, especially in the flip-chip configuration in which all of the electronic elements and coplanar transmission lines on the MMIC chips face a surface of a substrate on which all of the corresponding coplanar wave transmission lines are formed. This is because the conventional Lange coupler is a microstrip based design, with a single ground plane formed on the opposite surface of the substrate from the signal carrying microstrip lines. Microstrip arrangements are generally undesirable in that the numerous vias which must be formed through the chips and substrate for ground plane interconnection produce fragile MMIC chips.

SUMMARY OF THE INVENTION

The present invention is based on the realization that the spacing between adjacent signal conductor striplines in a coplanar waveguide based directional coupler may be increased while maintaining the requisite tight coupling by providing more than one stripline extending between the respective input and output ports. The spacing or width of the gaps between adjacent conductor striplines is roughly proportional to the number of gaps for a given coupling coefficient. Increasing the number of gaps therefore enables the gap width to be increased such that a coplanar waveguide directional coupler with a high coupling coefficient (e.g. 3dB) can be fabricated using fine-line lithographic technology commonly used in high yield GaAs based monolithic integrated circuit fabrication.

The coplanar circuit configuration provides easy ground plane access (as compared to a microstrip based Lange coupler), which is highly desirable for FET based MMICs and shunt connection of passive circuit elements. It is particularly useful for flip-chip mounting of MMICs, which enables the interconnection of microwave integrated circuits and digital signal processing chips on a common substrate.

In accordance with the present invention, a coplanar waveguide directional coupler may be formed on a surface of a substrate and/or a microwave monolithic integrated circuit (MMIC) chip, with the MMIC chip being flip-chip mounted on the substrate. The directional coupler includes input, coupled, direct and isolation ports formed on the surface. At least two parallel first striplines are formed on the surface and connected between the input and direct ports, while at least two parallel second striplines are formed on the surface and connected between the coupled and isolation ports. The second striplines are interdigitated with the first striplines to provide tight signal coupling therebetween. First and second main ground planes are formed on the surface and extend lateral to and on opposite sides of the interdigitated first and second striplines. The ports each include a coplanar waveguide section having a center conductor connected to the ends of the respective striplines, and first and second ground planes which extend parallel to the center conductor on opposite sides thereof and are connected in circuit to the main ground planes.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
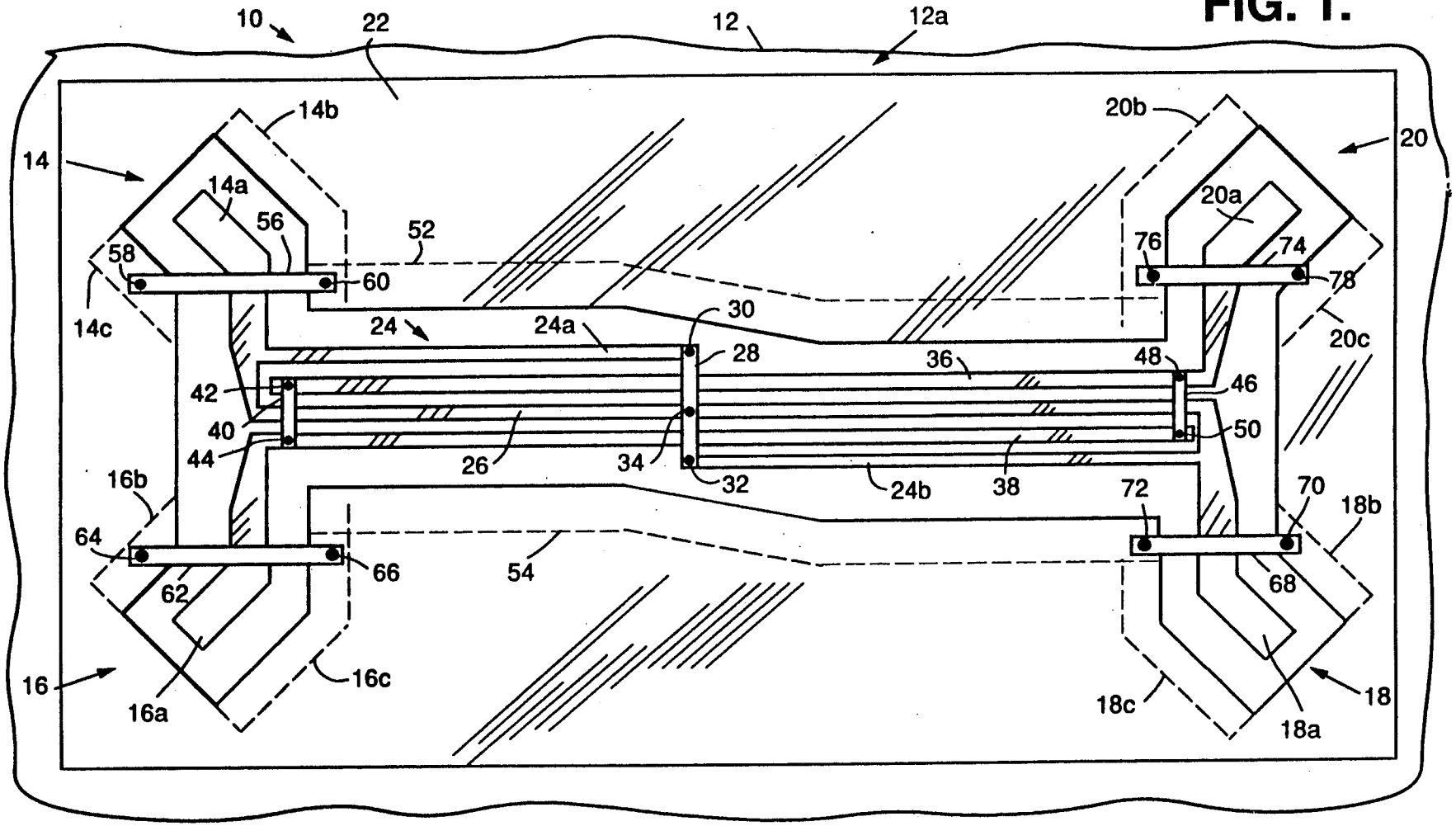
FIG. 1 is a plan view illustrating a coplanar waveguide directional coupler embodying the present invention.

Referring to FIG. 1 of the drawings, a coplanar waveguide directional coupler embodying the present invention is generally designated as 10, and comprises a substrate 12 having a surface 12*a* formed of an electrically insulative material such as undoped gallium arsenide. An input port 14, coupled port 16, direct port 18, and isolation port 20 are formed on the surface 12*a* of the substrate 12. The input port 14 includes a coplanar waveguide section consisting of a center conductor 14*a*, and first and second ground planes 14*b* and 14*c* that are spaced from and extend parallel to the center conductor 14*a* on opposite sides thereof. The outer edges of the ground planes 14*b* and 14*c* are indicated by broken lines. However, in practical application, the ground planes 14*b* and 14*c* may merge into a general ground plane 22 as illustrated which is formed on areas of the surface 12*a* not occupied by other elements of the coupler 10.

The coupled port 16 includes a coplanar waveguide section consisting of a center conductor 16*a*, and ground planes 16*b* and 16*c*. The direct port 18 includes a coplanar waveguide section consisting of a center conductor 18*a*, and ground planes 18*b* and 18*c*. The isolation port 20 includes a coplanar waveguide section consisting of a center conductor 20*a*, and ground planes 20*b* and 20*c*. The first and second ground planes of the coupled port 16, direct port 18, and isolation port 20 are spaced from and extend parallel to and on opposite sides of the respective center conductors, merging with the general ground plane 22, in the same manner as with the input port 14.

Two first parallel striplines 24 and 26 have first ends (left ends as viewed in FIG. 1) which are connected to the center conductor 14*a*of the input port 14, and second ends (ring ends as viewed in FIG. 1) which are connected to the center conductor 18*a* of the direct port 18. The stripline 24 includes two separate sections 24*a* and 24*b* which are interconnected by a jumper 28 using soldering, welding, or the like as indicated at 30 and 32. The stripline 26 may also be connected to the jumper as indicated at 34.

Two second parallel striplines 36 and 38 are spaced alternately between, or interdigitated with, the striplines 24 and 26. The first or left end of the stripline 38 is connected directly to the center conductor 16*a* of the coupled port 16, whereas the second or right end of the stripline 36 is connected directly to the center conductor 20*a* of the isolation port 20. The first ends of the stripline 36 and 38 are interconnected by a jumper 40 as indicated at 42 and 44, whereas the second ends of the striplines 36 and 38 are interconnected by a jumper 46 as indicated at 48 and 50. Although not visible in the drawing, air gaps or dielectric strips are provided between the lower surfaces of the jumpers 28, 40 and 46 and the upper surfaces of the corresponding striplines 24, 26, 36 and 38 where connection is not desired.

Main ground pales 52 and 54 are spaced from and extend parallel to the interdigitated striplines 24, 26, 36 and 38 on opposite sides thereof. The edges of the main ground planes 52 and 54 are indicated in broken line, but the ground planes 52 and 54 may merge into the general ground plane 22 int he same manner as the ground planes of the individual input and output ports. The main ground planes 52 and 54 are interconnected with the ground planes of the ports 14, 16, 18 and 20, through the general ground plane 22.

A jumper 56 may be provided which interconnects the ground planes 14*b* and 14*c* of the input port 14 as indicated at 58 and 60. The coupler 10 may further include a jumper 62 which interconnects the ground planes 16*b* and 16*c* of the coupled port 16 as indicated at 64 and 66, a jumper 68 which interconnects the ground planes 18*b* and 18*c* of the direct port 18 as indicated at 70 and 72, and a jumper 74 which interconnects the ground planes 20*b* and 20*c* of the isolation port 20 as indicated at 76 and 78.

The directional coupler 10 may be used as a signal splitter by applying an input signal to the center conductor 14*a* of the input port 14, and connecting the center conductor of the isolation port 20 to the ground plane 22 by means of a terminating resistor (not shown). Due to inductive signal coupling between the striplines 24, 26, 36 and 38, the input signal will appear at the coupled and direct ports 16 and 18 with respective amplitudes and power levels depending on the coupling ratio of the coupler 10. If the coupling ratio is selected as 3 dB, the signals appearing at the ports 16 and 18 will have equal amplitudes and power levels, and the terminating resistor will have a value of 50 ohms.

The directional coupler 10 may also be used as a signal mixer or power combiner by applying two input signals to the center conductors 14*a* and 20*a* of the input and isolation ports 14 and 20, and taking the combined output from the junction of two diodes (not shown) which are connected with opposite polarity to the center conductors 16*a* and 18*a* of the coupled and direct ports 16 and 18 respectively.

The main ground planes 52 and 54 enable the directional coupler 10 to be used in a coplanar waveguide configuration which is applicable to flip-chip MMIC fabrication. This is because the directional coupler 10 is a coplanar waveguide element, and is compatible with the other coplanar waveguide elements and coplanar waveguide interconnects formed on the facing surfaces of a MMIC chip and substrate in a flip-chip mounting arrangement.

The interdigitated striplines 24, 26, 36 and 38 enable a spacing S between adjacent first and second striplines to be increased to a level which is compatible with current integrated circuit fabrication technology. In the configuration described in the above referenced article to C. Wen which includes a single stripline interconnecting each respective pair of ports, a spacing $S_1$ between the strip-lines for operation at microwave frequencies is on the order of one micrometer. This spacing is too small to be achieved using current technology, which is limited to minimum spacings on the order of 5 micrometers.

Increasing the number of striplines increases the number of gaps between adjacent striplines, and the total length of the edges of the electrically conductive striplines which face each other across the gaps. This increases the total capacitance of the striplines, which in turn increases the coupling ratio. Increasing the spacing S has the opposite effect of decreasing the capacitance and coupling ratio. Thus, the spacing S may be increased if more striplines are added to increase the capacitance and coupling ratio to compensate for the reductions caused by increasing the spacing S. In the present directional coupler 10, the spacing S is approximately equal to $S=N \times S_1$, where N is the total number of first and second striplines.

The present directional coupler 10 may be configured for 3 dB coupling operation at a frequency of 10.6 GHz by providing the substrate 12 of gallium arsenide, and making the striplines 24, 26, 36 and 28 approximately 1,719 micrometers long. This length corresponds to approximately $\frac{1}{4}$ of the wavelength of the 10.6 GHz signal in gallium arsenide. The spacing S between adjacent striplines 24, 26, 36 and 38 may be approximately 5 micrometers, with the width of the striplines being approximately 10 micrometers.

The spacing $S_1$ is approximately five times greater than the spacing $S_1$ required for single striplines in the arrangement described in the Wen article, making the present directional coupler technically feasible to manufacture on a commercial production basis. Although $N \times S_1=4$ micrometers in this example, the spacing of $S=5$ micrometers is sufficiently small for many practical applications.

The spacing between the outer edges of the interdigitated striplines and the inner edges of the main ground planes 52 and 54 will, in the present example, be approximately 65 micrometers. This value was calculated using the conformal transformation algorithms set forth in the article to Wen, on the assumption that the combined striplines 24, 26, 36 and 38 are considered to electrically function as a single stripline.

Figure 2A:
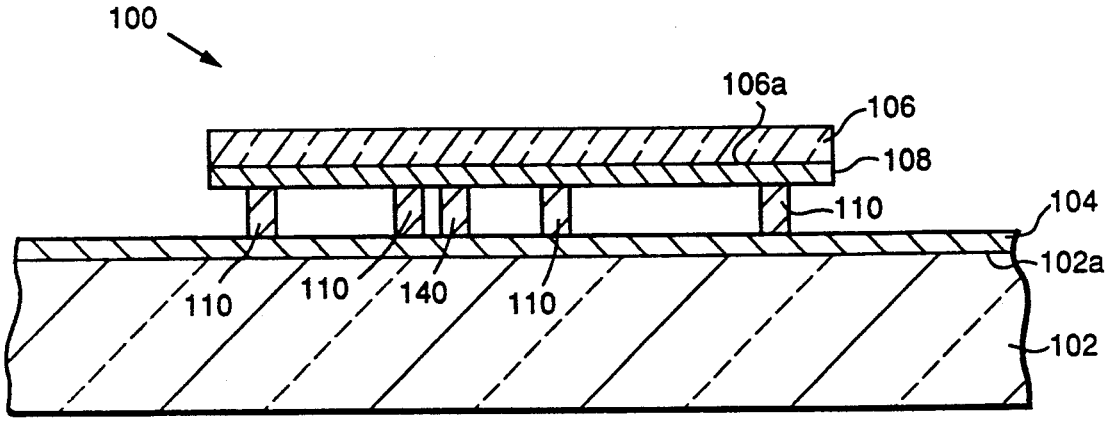
FIG. 2*a* is a simplified side elevational view illustrating a microwave monolithic integrated circuit (MMIC) assembly incorporating the present coplanar waveguide directional coupler.
Figure 2B:
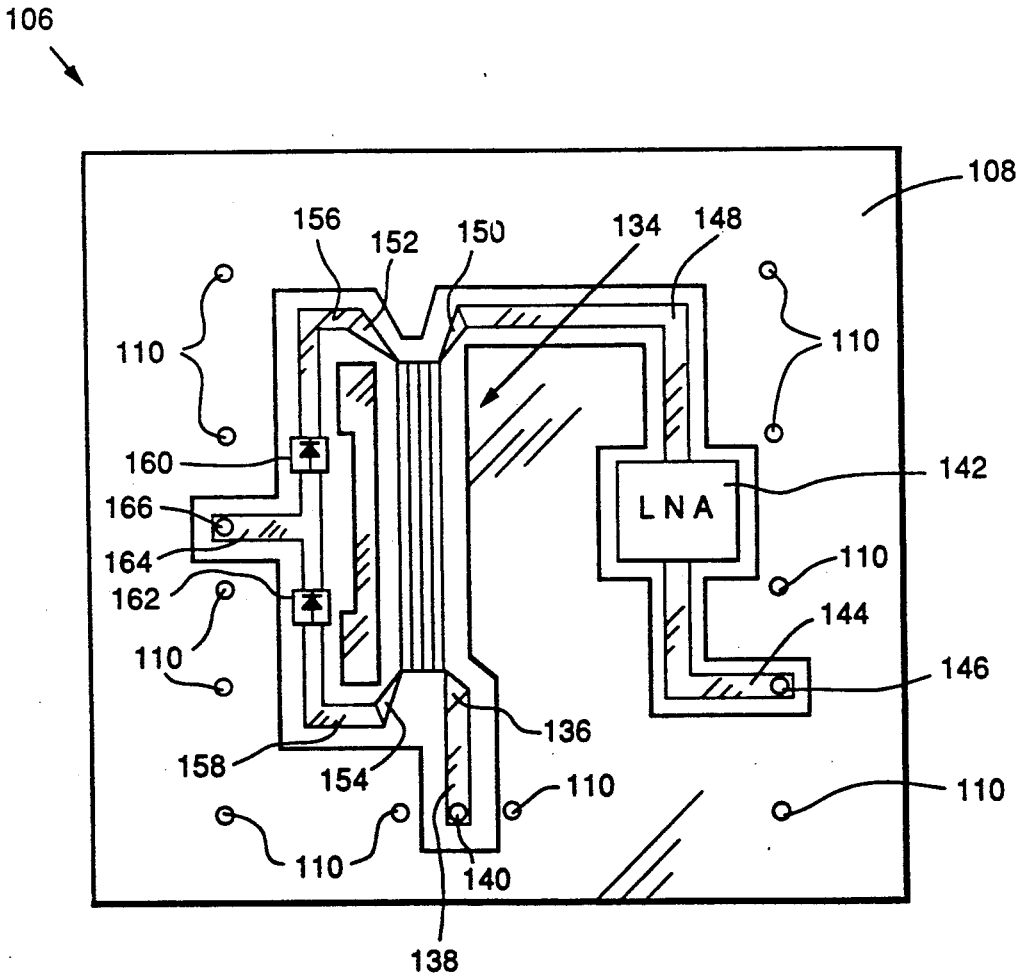
FIG. 2*b* is a simplified plan view illustrating a MMIC chip of the assembly shown in FIG. 2*a*.
Figure 2C:
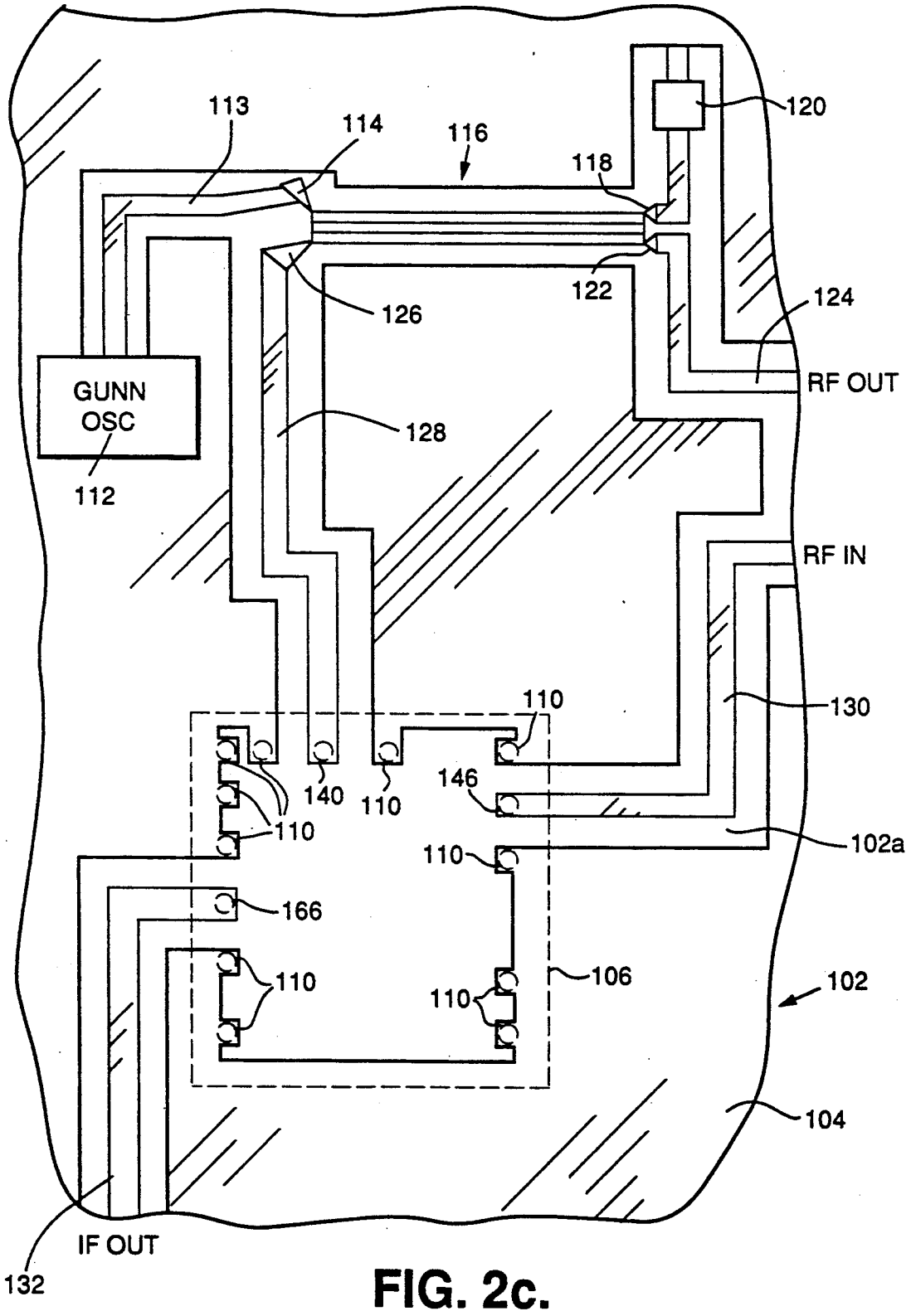
FIG. 2*c* is a simplified plan view illustrating a microwave integrated circuit (MIC) substrate on which the MMIC chip of FIG. 2*b* is flip-chip mounted.

The coplanar waveguide architecture of the present directional coupler 10 enables it to be advantageously incorporated into a flip-chip MMIC assembly 100 as illustrated in FIGS. 2*a* to 2*c*. The assembly 100 is illustrated for exemplary purposes as constituting part of a Doppler radar transceiver, and includes an electrically insulative microwave integrated circuit (MIC) substrate 102 having a general ground plane 104 formed on a surface 102*a* thereof. The assembly 100 further includes a MMIC integrated circuit chip 106 having a general ground plane 108 formed on a surface 106*a* thereof. The chip 106 is flip-chip mounted on the substrate 102 such that the surfaces 102*a* and 106*a* face each other.

FIG. 2*b* illustrates the surface 106*a* of the chip 106 which faces the substrate 102, whereas FIG. 2*c* illustrates the surface 102*a* of the substrate 102 which faces the chip 106 when the chip 106 is flip-chip mounted on the substrate 102. The general ground planes 104 and 108 are interconnected by means of electrically conductive bumps 110 which extend from the ground plane 108 of the chip 102 and are soldered, welded, or otherwise connected to the ground plane 104 of the substrate 102.

As illustrated in FIG. 2*c*, a radio frequency signal from a Gunn master oscillator 112 is applied via a center conductor or stripline 113 to an input port 114 of a coplanar waveguide directional coupler 116 formed on the substrate 102. The coupler 116 has the same construction and includes all of the elements of the coupler 10. The individual elements of the coupler 116 which are too small to be visible in FIG. 2*c* are considered as being designated by the same reference numerals used in FIG. 1.

The coupler 116 is arranged to operate as a signal splitter, and further includes an isolation port 118 connected to the general ground plane 104 through a terminating resistor 120. A direct port 122 of the coupler 116 is connected through a center conductor or stripline 124 to a transmitting radar antenna (not shown) to provide a signal RF OUT. A component of the signal RF OUT also appears as a local oscillator signal LO at a coupled port 126 of the coupler 116, which is connected to a center conductor or stripline 128. A center conductor or strip-line 130 is also formed on the surface 102*a* of the substrate 102 which receives a signal RF IN from a receiving radar antenna (not shown). A center conductor or stripline 132 is also provided to conduct an intermediate frequency signal IF OUT to a downstream signal processing section (not shown) of the radar transceiver.

As illustrated in FIG. 2*b*, another coplanar waveguide directional coupler 134 is formed on the surface 106*a* of the MMIC chip 106. The coupler 134 has the same construction and includes all of the elements of the coupler 10. The individual elements of the coupler 134 which are too small to be visible in FIG. 2*b* are considered as being designated by the same reference numerals used in FIG. 1.

The coupler 134 is connected to operate as a mixer, and includes an input port 136 which is connected to a center conductor or stripline 138. An electrically conductive bump 140 is formed on the stripline 138 which electrically connects the input port 136 of the coupler 134 to the coupled port 126 of the coupler 114 on the substrate 102 via the striplines 128 and 138 when the chip 106 is flip-chip mounted on the substrate 102. The local oscillator signal LO is thereby applied to the input port 136 of the coupler 134. A low noise amplifier 142 is formed on the surface 106*a* of the chip 106, having an input connected to a center conductor or stripline 144. An electrically conductive bump 146 is formed on the stripline 144 to connect the input of the amplifier 142 to receive the signal RF IN through the stripline 144 and the stripline 130 on the substrate 102.

The output of the amplifier 142 is connected through a center conductor or stripline 148 to an isolation port 150 of the coupler 134. The amplified received signal RF IN is mixed with the local oscillator signal LO in the coupler 134, and a combined signal appears at a direct port 152 and a coupled port 154 of the coupler 134. The direct and coupled ports 152 and 154 are connected through center conductors or striplines 156 and 158 and oppositely connected diodes 160 and 162 respectively to a center conductor or stripline 164. An electrically conductive bump 166 is formed on the stripline 164, which connects the combined outputs from the direct and coupled ports 152 and 154 of the coupler 134 via the stripline 164 to the stripline 132 on the substrate 102 as the output signal IF OUT.

The center conductors or striplines 113, 124, 128, 130 and 132 are configured in combination with the general ground plane 104 on the substrate 102 to constitute elements of a coplanar waveguide interconnect means of the substrate 102. Similarly, the center conductors 138, 144, 148, 156, 158 and 164 are configured in combination with the general ground plane 108 to constitute elements of a coplanar waveguide interconnect means of the MMIC chip 106.

It will be understood that although the present directional coupler 10 is illustrated as including two first striplines 24 and 26, and two second striplines 36 and 38, it is within the scope of the invention to provide more than two of each of the first and second striplines. This would enable the spacing between adjacent striplines to be increased to an even larger value than is possible with the illustrated configuration.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

We claim:

1. A coplanar waveguide directional coupler, comprising:

a substrate having a surface;

an input port, a coupled port, a direct port and an isolation port formed on said surface;

at least two parallel first striplines formed on said surface and connected between the input port and the direct port;

at least two parallel second striplines formed on said surface and connected between the coupled port and the isolation port, the second striplines being interdigitated with the first striplines; and first and second main ground planes formed on said surface and extending lateral to and on opposite sides of said interdigitated first and second striplines;

wherein the input port includes a coplanar waveguide section including a center conductor connected to one end of the first striplines, and a pair of ground planes extending lateral to the center conductor on opposite sides thereof and being connected in circuit to the first and second main ground planes;

the coupled port includes a coplanar waveguide section including a center conductor connected to one end of the second striplines, and a pair of ground planes extending lateral to the center conductor on opposite sides thereof and being connected in circuit to the first and second main ground planes;

the direct port includes a coplanar waveguide section including a center conductor connected to the opposite end of the first striplines, and a pair of ground planes extending lateral to the center conductor on opposite sides thereof and being connected in circuit to the first and second main ground planes; and the isolation port includes a coplanar waveguide section including a center conductor connected to the opposite end of the striplines, and a pair of ground planes extending parallel to the center conductor on opposite sides thereof and being connected in circuit to the first and second main ground planes.

2. A directional coupler as in claim 1, further comprising jumpers which interconnect the first and second ground planes of the coplanar waveguide sections of each of the input, coupled, direct and isolation ports, respectively.

3. A coplanar waveguide directional coupler, comprising:

a substrate having a surface;

an input port, a coupled port, a port and an isolation port formed on said surface;

at least two parallel first striplines formed on said surface and connected between the input port and the direct port;

at least two parallel second striplines formed on said surface and connected between the coupled port and the isolation port, the second striplines being interdigitated with the first striplines; and first and second main ground planes formed on said surface and extending lateral to and on opposite sides of said interdigitated first and second striplines;

in which the spacing S between adjacent first and second striplines is approximately equal to $S=N\times S_1$, where $S_1$ is the spacing between first and second striplines if only one first stripline and one second stripline were provided, and N is the total number of first and second striplines.

4. A directional coupler as in claim 3, in which the substrate is formed of gallium arsenide, the anticipated frequency of an input signal to be applied to the input port is approximately 10.6 GHz, S is approximately 5 micrometers, the width of the first and second striplines is approximately 10 micrometers, and the length of the first and second striplines is approximately 1,719 micrometers.

5. A microwave monolithic integrated circuit (MMIC) assembly, comprising:

a substrate having a surface;

coplanar waveguide interconnect means formed on said surface of the substrate;

a MMIC chip having a surface;

coplanar waveguide interconnect means formed on said surface of the MMIC chip;

the MMIC chip being flip-chip mounted on the substrate such that said surface of the MMIC chip faces said surface of the substrate;

interconnect means interconnecting said coplanar waveguide interconnect means of the MMIC chip with said coplanar waveguide interconnect means of the substrate; and a coplanar waveguide directional coupler formed on said surface of the MMIC chip and being interconnected with said coplanar waveguide interconnect means thereof, the directional coupler including;

an input port, a coupled port, a direct port and an isolation port formed on said surface of the MMIC chip;

at least two parallel first striplines formed on said surface of the MMIC chip and connected between the input port and the direct port;

at least two parallel second striplines formed on said surface of the MMIC chip and connected between the coupled port and the isolation port, the second striplines being interdigitated with the first striplines; and first and second main ground planes formed on said surface of the MMIC chip and extending lateral to and on opposite sides of said interdigitated first and second striplines.

6. An assembly as in claim 5, in which:

the input port includes a coplanar waveguide section including a center conductor connected to one end of the first striplines, and a pair of ground planes extending lateral to the center conductor on opposite sides thereof and being connected in circuit to the first and second main ground planes;

the coupled port includes a coplanar waveguide section including a center conductor connected to one end of the second striplines, and a pair of ground planes extending lateral to the center conductor on opposite sides thereof and being connected in circuit to the first and second main ground planes;

the direct port includes a coplanar waveguide section including a center conductor connected to one end of the first striplines, and a pair of ground planes extending lateral to the center conductor on opposite sides thereof and being connected in circuit to the first and main second ground planes; and the isolation port includes a coplanar waveguide section including a center conductor connected to one end of the second striplines, and a pair of ground planes extending lateral to the center conductor on opposite sides thereof and being connected in circuit to the first and second main ground planes.

7. An assembly as in claim 6, further comprising jumpers which interconnect the first and second ground planes of the coplanar waveguide sections of each of the input, coupled, direct and isolation ports, respectively.

8. An assembly as in claim 5, in which the first and second striplines each have a length which is substantially equal to one quarter of the anticipated wavelength of an input signal to be applied to the input port.

9. A microwave monolithic integrated circuit (MMIC) assembly, comprising:

a substrate having a surface;

coplanar waveguide interconnect means formed on said surface of the substrate;

a MMIC chip having a surface;

coplanar waveguide interconnect means formed on said surface of the MMIC chip;

the MMIC chip being flip-chip mounted on the substrate such that said surface of the MMIC chip faces said surface of the substrate;

interconnect means interconnecting said coplanar waveguide interconnect means of the MMIC chip with said coplanar waveguide interconnect means of the substrate; and a coplanar waveguide directional coupler formed on said surface of the substrate and being interconnected with said coplanar waveguide interconnect means thereof, the directional coupler including;

an input port, a coupled port, a direct port and an isolation port formed on said surface of the substrate;

at least two parallel first striplines formed on said surface of the substrate and connected between the input port and the direct port;

at least two parallel second striplines formed on said surface of the substrate and connected between the coupled port and the isolation port, the second striplines being interdigitated with the first striplines; and first and second main ground planes formed on said surface of the substrate and extending lateral to and on opposite sides of said interdigitated first and second striplines.

10. An assembly as in claim 9, in which:

the input port includes a coplanar waveguide section including a center conductor connected to one end of the first striplines, and a pair of ground planes extending lateral to the center conductor on opposite sides thereof and being connected in circuit to the first and second main ground planes;

the coupled port includes a coplanar waveguide section including a center conductor connected to one end of the second striplines, and a pair of ground planes extending lateral to the center conductor on opposite sides thereof and being connected in circuit to the first and second main ground planes;

the direct port includes a coplanar waveguide section including a center conductor connected to one end of the first striplines, and a pair of ground planes extending lateral to the center conductor on opposite sides thereof and being connected in circuit to the first and main second ground planes; and the isolation port includes a coplanar waveguide section including a center conductor connected to one end of the second striplines, and a pair of ground planes extending lateral to the center conductor on opposite sides thereof and being connected in circuit to the first and second main ground planes.

11. An assembly as in claim 10, further comprising jumpers which interconnect the first and second ground planes of the coplanar waveguide sections of each of the input, coupled, direct and isolation ports, respectively.

12. An assembly as in claim 9, in which the first and second striplines each have a length which is substantially equal to one quarter of the anticipated wavelength of an input signal to be applied to the input port.

* * * * *